United States Patent [19]

Saloom

[11] 4,455,023

[45] Jun. 19, 1984

[54] DUAL PURPOSE WEAPON FOR USE BY POLICE OFFICERS

[76] Inventor: George Saloom, 334 Church La., North Brunswick, N.J. 08902

[21] Appl. No.: 469,250

[22] Filed: Feb. 24, 1983

[51] Int. Cl.[3] ..... F41B 15/02

[52] U.S. Cl. ..... 273/84 R; 272/143

[58] Field of Search ..... 273/84 R, 84 ES, 81 A; 272/124, 119, 67, 68, 143

[56] References Cited

U.S. PATENT DOCUMENTS

| | | | |
|---|---|---|---|
| 1,490,651 | 4/1924 | Waldorf | 273/84 R |
| 1,586,412 | 5/1926 | Curtis | 273/84 |
| 1,920,519 | 8/1933 | Morrissey | 273/84 |
| 2,634,535 | 4/1953 | Borders | 273/84 R |

FOREIGN PATENT DOCUMENTS

| | | | |
|---|---|---|---|
| 97224 | 6/1924 | Fed. Rep. of Germany | 273/84 |

*Primary Examiner*—George J. Marlo
*Attorney, Agent, or Firm*—Arthur L. Plevy

[57] ABSTRACT

There is disclosed a club weapon which may be employed by a police officer or by security personnel. The weapon is basically a club-like member having a grooved handle section which section contains two separate apertures. These apertures accommodate a leather pouch which is symmetrically disposed and having left and right extending tie elements on either side. Each tie is insertable through a corresponding aperture to allow the user to adjust the pouch so that it rests comfortably on the top surface of the user's hand. The pouch is filled with a powdered lead or a similar metallic substance to enable the user to firmly grasp the club at the handle end and to use the leather pouch in a manner similar to the use of a pair of brass knuckles to thereby impart greater force when striking an assailant.

14 Claims, 4 Drawing Figures

DUAL PURPOSE WEAPON FOR USE BY POLICE OFFICERS

BACKGROUND OF THE INVENTION

This invention relates to weapons and more particularly to a club weapon used by security personnel as police officers to subdue criminals and to further permit use of the weapon in relatively confined areas.

The prior art is replete with a number of patents which show various club-like devices providing a means of defense to police officers or other individuals.

U.S. Pat. No. 1,920,519 entitled POLICE CLUB issued on Aug. 13, 1933 to M. F. Morrissey shows a club which consists of a flat slab of reinforced rubber. The club has a hand hole through it at one end to allow a user to grasp the same. U.S. Pat. No. 2,391,782 entitled POLICE WEAPON issued on Dec. 25, 1945 to R. L. Hutchison depicts a similar apparatus to the one described above. Various other patents disclose many types of devices such as clubs together with peripheral attachments which are all adapted for the purpose of restraining people and essentially to serve as an effective weapon. Further examples of typical apparatus are depicted in U.S. Pat. Nos. 3,106,398 and 3,385,601.

In spite of the many devices that exist in the patent literature the typical policeman carries a club which is a relatively long wooden instrument and is sometimes referred to as a night-stick.

In any event, the present clubs are difficult to utilize in a confined situation such as in a hallway or in an automobile and are not particularly effective in that environment due to the length of the club and further due to the general effectiveness of such a club in confined quaters.

It is therefore an object of the present invention to provide a new and improved club-like instrument which can be utilized in close quarters and which further contains a selectively adjustable handle strap assembly which functions as a further weapon to thereby impart a dual function to the club and weapon according to this invention.

BRIEF DESCRIPTION OF THE PREFERRED EMBODIMENT

A dual purpose club-weapon for use by security personnel, comprising a longitudinal rod member of a generally circular cross section and having near one end and adjustably secured thereto a flexible pouch member having a hollow containg a heavy powdered material, to enable a user to insert his hand about said one end of said rod member and to adjust said pouch member to cover the outer surface of the user's hand to enable use of the pouch or rod to impart a blow to an assailant.

DETAILED DESCRIPTION OF THE FIGURES

Figure 1:
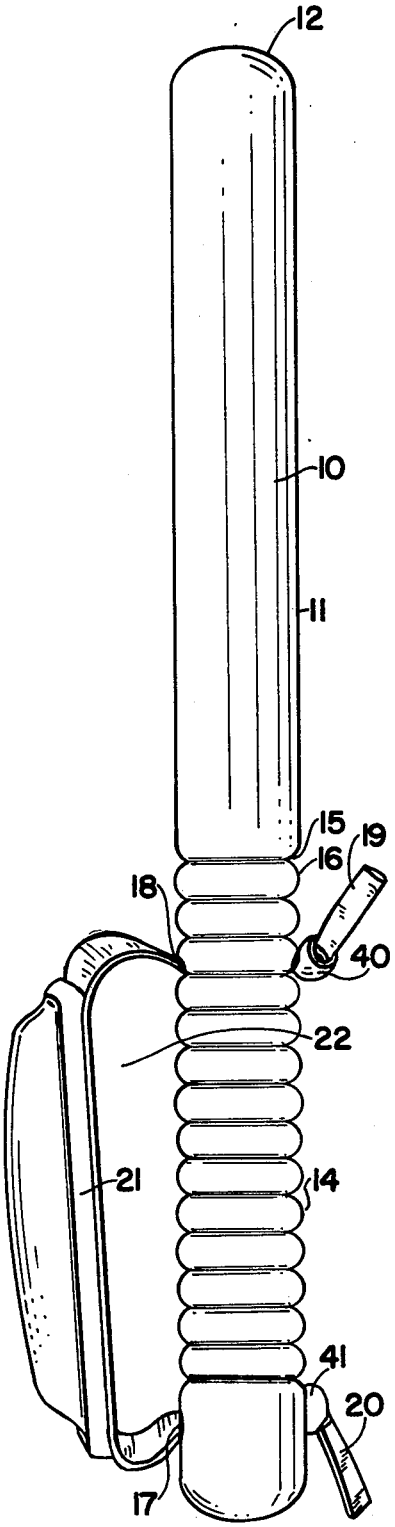
FIG. 1 is a perspective plan view of a club weapon according to this invention.

Referring to FIG. 1, there is shown a perspective plan view of a weapon according to this invention.

Essentially, the weapon is a club-like member 10 generally a longitudinal cylindrical member fabricated from wood or a similar material. The top portion 11 of the club 10 is characterized by having a circular cross section with a smooth or rounded top end 12 and appears as a conventional type of club. At the other end is a handle section 14 which is manifested by a series of peripheral grooves as 15 which separate and form a series of raised projections 14. As one can see, the grooves enable the user such as a police officer to firmly clasp the weapon.

As will be explained, on the handle portion 14 are two apertures 17 and 18. These apertures allow one to insert flexible tie or strap members as 19 and 20. The tie or strap members 19 and 20 are integrally formed with a central container member 21. The member 21 houses a plurality of metal particles such as metal shot, metal dust, or some other suitable heavy metal. In this manner a user inserts the ties 19 and 20 which are integral with the central housing 21 to a desired length so that the member 21 overlies the top surface of the user's hand when it is inserted into the space 22 between the handle and the central housing 21.

Thus, as can be seen, the flexible apparatus can be adjusted by each user to optimumly and snugly fit about the user's hand while the metal ladden housing can be used in a similar manner to a pair of brass knuckles to allow the officer to gain additional force when stricking an assailant.

The handle member further serves as a gripping mechanism to thereby prevent the club from being pulled from the officer when performing his duty.

A typical club according to this invention is shorter than conventional clubs as presently employed and may, for example, be approximately 14 inches in length from top to bottom with the handle section containing 13 grooves and being about 8½ inches in length. The apertures as 17 and 18 are ¼ inch holes which are approximately drilled 4 inches apart and lie in proximity and transverse to the main axis of the handle portion of the rod-like club member 11.

Figure 2:
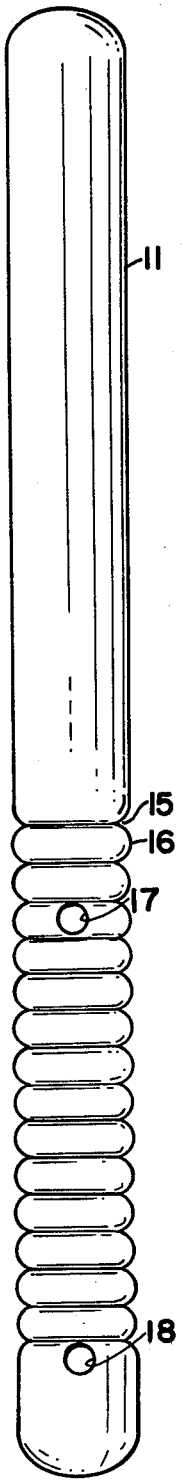
FIG. 2 is a top plan view of the main cylindrical club section of the weapon.

Referring to FIG. 2, there is shown a plan view of the club body 11 clearly depicting apertures 17 and 18 together with the grooves 15 and the raised ridges or projections 16.

Figure 3:
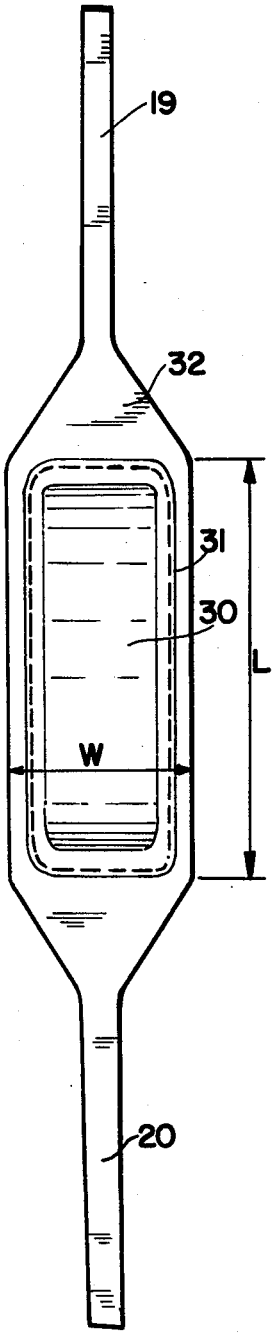
FIG. 3 is a top plan view of a flexible weight containing a handle restraining member.

FIG. 3 depicts the flexible handle element which preferably is fabricated from a leather or vinyl. The handle member consists of a central portion 21 which has a top cover member 30 which may be sewn, glued or otherwise secured to the base 32.

Figure 4:
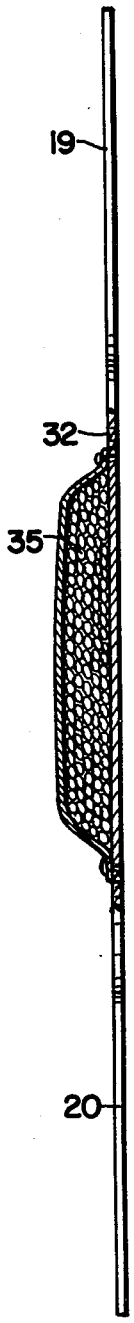
FIG. 4 is a partial cross sectional view depicting the member of FIG. 3.

As indicated, the member 21 thus forms a pocket into which is inserted metal shot or metal particles 35 as shown in the partial cross sectional view of FIG. 4. Extending from the base 32 of the member 21 are the tie or strap members 19 and 20. Each tie member is approximately ¼ inch wide and of a sufficient length to accommodate the typical hand of most users. The central member 21 is approximately 4 inches L and about ½ inch W. The cover member 30 as shown is rectangular in configuration and is secured to the base member 32 as above indicated. The hollow is then filled with a metal shot such as powdered lead. As seen in FIG. 1, the user inserts each tie as 19 and 20 into the corresponding aperture, and when proper adjustment and feel is achieved, knots 40 and 41 (FIG. 1) are formed to firmly hold the leather pouch apparatus in a permanent position on the handle.

It is of course understood that the club 11 can be fabricated from many different types of material such as a light metal or wood. In particular a coca-bola wood has been employed as the club portion. This wood is extremely strong and relatively heavy and is capable of withstanding rugged use without stress or fracture. The tie members and pouch, see FIG. 3, are preferably formed from a suitable leather and the pouch is filled with powdered lead. In any event, the tie member can be also formed from any flexible type of material such as a suitable plastic or vinyl and so on.

As one will understand, the above noted dimensions and materials are given by way of example and various modifications and alternatives will be discerned by one skilled in the art upon reading this disclosure and all such modifications are deemed to be encompassed within the spirit and scope of the claims appended hereto.

I claim:

1. A dual purpose club-weapon for use by security personnel comprising:

a longitudinal rod member of a generally circular cross section and having near one end and adjustably secured thereto a flexible pouch member having a hollow containing a powdered metal particle material, to enable a user to insert his hand about said one end of said rod member and to adjust said pouch member to cover the outer surface of the user's hand to enable use of the pouch or rod to impart a blow to an assailant.

2. The club weapon according to claim 1, wherein said one end of said rod is a handle end characterized in having a plurality of symmetrically spaced grooves to provide a firm gripping surface for a user.

3. The club-weapon according to claim 2, wherein said handle end includes a first and a second spaced apertures, with said pouch member having a left and right extending tie member, each of which is directed through an associated aperture according to the preferences of a user and means secured to said tie member to secure the same to said rod via said apertures as selectively adjusted.

4. The club-weapon according to claim 3, wherein said means are knots integrally formed in said tie members and of a larger diameter than said apertures to hold said tie members and therefore said pouch to said rod.

5. The club-weapon according to claim 4, wherein said heavy powdered material is a powdered lead.

6. The club-weapon according to claim 1, wherein said rod is fabricated from wood.

7. The club-weapon according to claim 1, wherein said pouch member is fabricated from leather.

8. A dual purpose club-weapon for use by a police officer or similar individual, comprising;

a longitudinal rod member of a generally circular cross section and having a lower handle end section and an upper club section, the surface of said handle section containing a first and a second spaced apart apertures each directed through said rod, a flexible pouch member having a central section containing a hollow for accommodating a heavy powdered material, with a right and a left strap extending from each side of said pouch member, with one of said straps inserted through said first aperture and via one surface opening and knotted to retain the same therein after insertion, and with said other strap inserted through said second aperture via said one surface and also knotted to retain the same therein, with said straps inserted and knotted according to the preferences of said user as determined by his hand size and whereby both said club and said pouch can be employed to strike an assailant.

9. The club-weapon according to claim 8, wherein said handle end section further includes a plurality of symmetrically spaced grooves to facilitate gripping said rod.

10. The club-weapon according to claim 8, wherein said rod member is fabricated from coca bola wood.

11. The club-weapon according to claim 8, wherein said flexible pouch member is fabricated from a leather like material, with a flat base section having a wide central area with said first and second straps depending therefrom at right and left sides, and having a corresponding cover member secured to said base member at said central area to form a pouch having an internal hollow for accommodating said heavy powdered material.

12. The club-weapon according to claim 11, wherein said heavy powdered material is powdered lead.

13. The club-weapon according to claim 11, wherein said cover member is secured to said base member by sewing one to the other.

14. The club-weapon according to claim 11, wherein said wide cental area is of a length substantially equal to the length of said handle section.

* * * * *